US005801324A

United States Patent [19]

Pickard

[11] Patent Number: 5,801,324

[45] Date of Patent: Sep. 1, 1998

[54] DIVIDING BULLET HAVING LONGITUDINALLY JOINED JACKETED PROJECTILE SEGMENTS THAT SEPARATE UPON TARGET IMPACT

[76] Inventor: Richard Pickard, 20505 E. Country Club Dr., Suite 335, Aventura, Fla. 33180

[21] Appl. No.: 831,458

[22] Filed: Mar. 31, 1997

[51] Int. Cl.[6] ..... F42B 12/34

[52] U.S. Cl. ..... 102/516; 102/506; 102/517

[58] Field of Search ..... 102/501, 502, 102/506–510, 514–518, 529

[56] References Cited

U.S. PATENT DOCUMENTS

| | | | |
|---|---|---|---|
| 90,732 | 6/1869 | Curtis | 102/91 |
| 122,620 | 1/1872 | Maduell | 102/506 |
| 221,249 | 11/1879 | Nowlan | 102/506 |
| 275,674 | 4/1883 | Littlepage | 102/506 |
| 948,148 | 2/1910 | Schenk | 102/506 |
| 2,661,694 | 12/1953 | Allen et al. | 102/91 |
| 3,097,603 | 7/1963 | Harper | 102/506 |
| 3,138,102 | 6/1964 | Meyer et al. | 102/92.5 |
| 3,282,214 | 11/1966 | Briscoe | 102/38 |
| 3,665,861 | 5/1972 | Jaslow | 102/93 |
| 4,836,110 | 6/1989 | Burczynski | 102/508 |
| 4,947,755 | 8/1990 | Burczynski | 102/506 |
| 5,009,164 | 4/1991 | Grinberg | 102/501 |
| 5,528,989 | 6/1996 | Briese | 102/506 |

FOREIGN PATENT DOCUMENTS

| | | | |
|---|---|---|---|
| 3822775 | 2/1990 | Germany | 102/507 |
| 311620 | 5/1929 | United Kingdom | 102/507 |

*Primary Examiner*—Harold J. Tudor
*Attorney, Agent, or Firm*—George R. McGuire

[57] ABSTRACT

A dividing bullet includes a projectile body and a seam through the projectile body. The projectile body has a longitudinal central axis and a plurality of individually jacketed longitudinally extending segments. Each segment has an inner core of a first material and outer jacket of a second material substantially encasing the inner core of the first material. The plurality of jacketed segments are symmetrically disposed about the longitudinal central axis. The seam extends through the projectile body between the individually jacketed segments thereof. The individually jacketed segments are joined together at the seam by a joint that is weaker in strength than the second material making up the outer jacket of each of the jacketed segments such that the projectile body will separate at the seam into the jacketed segments upon impact with a target. The second material of the outer jacket of each of the jacketed segments is greater in strength than the first material of the inner core thereof. The plurality of jacketed segments can be two, three or four in number.

17 Claims, 2 Drawing Sheets

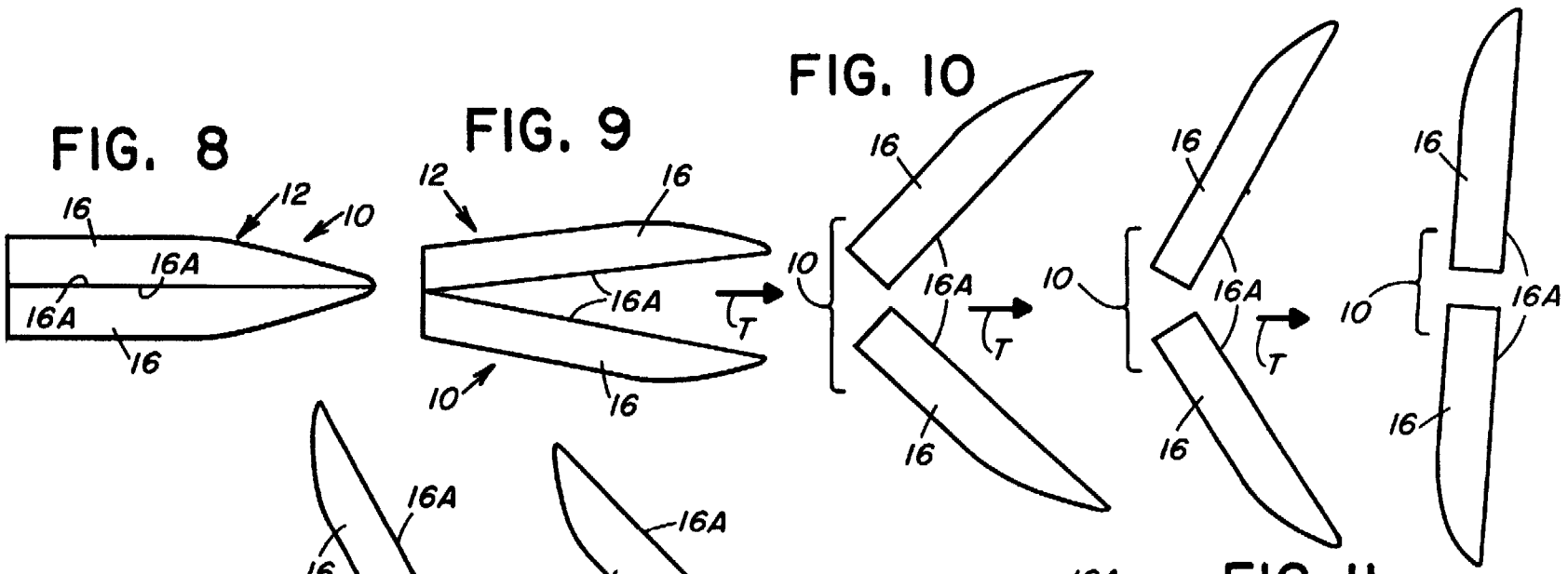
FIG. 8
FIG. 9
FIG. 10
FIG. 11
FIG. 12
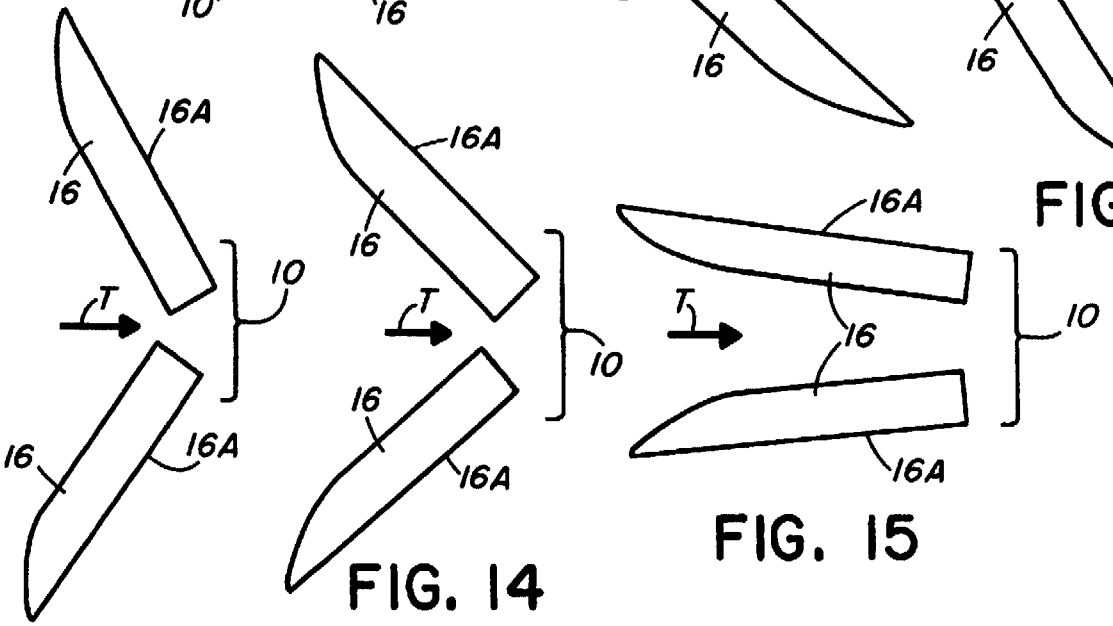
FIG. 13
FIG. 14
FIG. 15

DIVIDING BULLET HAVING LONGITUDINALLY JOINED JACKETED PROJECTILE SEGMENTS THAT SEPARATE UPON TARGET IMPACT

CROSS-REFERENCE TO RELATED APPLICATION

Reference is hereby made to the following copending U.S. application dealing with subject matter related to the present invention: "Dividing Bullet With Weakened Longitudinal Seam For Separating Into Halves Upon Impact With Target" by Richard Pickard, assigned U.S. Ser. No. 08/829,206 and filed 3/31/97.

BACKGROUND OF THE INVENTION

1. Field of the Invention

The present invention generally relates to bullet constructions and, more particularly, is concerned with a dividing bullet made up of a plurality of individually jacketed longitudinally extending projectile segments that are bonded together and adapted to separate upon impact with a target.

2. Description of the Prior Art

A bullet for use in hunting and personal defense ideally will travel accurately in flight from the gun to the target and upon impact with the target deliver a substantial shock and then penetrate the target body creating a wound channel of substantial cross-sectional size before exiting the target. The most violent, shocking, destructive and largest wound channels are made from a large cross section perpendicular to the axis of travel within the target. Also for a bullet to be effective it must retain as much of its weight after impact as possible so that it will maintain the momentum necessary to force its way through the target to make deep penetration.

Typical conventional hunting and personal defense bullets are made with a soft lead core projectile and a copper jacket covering all but about 10% of the projectile at the tip. Upon striking the target, these bullets are designed to deform into a mushroom-shape, making a large wound channel in the target body and providing substantial impact shock. However, a drawback of the mushroom-shape deformation is that substantial fragmentation of the bullet results, for example from about 40% to 50% of the bullet weight. The small fragments or pieces of the lead and copper jacket that break away from the bullet serve no useful purpose and reduce the overall weight retention of the bullet, thereby reducing its penetration capability and in many cases causing no exit wound. Substantial penetration is necessary for the bullet to completely pass through all of the vital organs, and the exit wound is important to leave a large blood trail.

Many different bullet designs have been proposed in the prior art. Representative examples of these bullets are disclosed in U.S. Pat. No. 90,732 to Curtis, U.S. Pat. No. 122,620 to Maduell, U.S. Pat. No. 221,249 to Nowlan, U.S. Pat. No. 275,674 to Littlepage, U.S. Pat. No. 948,148 to Schenk, U.S. Pat. No. 2,661,694 to Allen et al., U.S. Pat. No. 3,097,603 to Harper, U.S. Pat. No. 3,138,102 to Meyer et al., U.S. Pat. No. 3,282,214 to Briscoe, U.S. Pat. No. 3,665,861 to Jaslow, U.S. Pat. Nos. 4,836,110 and 4,947,755 to Burczynski and U.S. Pat. No. 5,528,989 to Briese. However, it appears likely that most of these prior art bullets would meet with only limited success, if any at all, due to one or more of the following drawbacks: the multiplicity of parts forming the bullets would enhance rather than diminish their tendency toward fragmentation and achieve poor penetration; and the wedged, lopsided or asymmetrical shapes of the bullets would cause a wobbling of the bullet during flight and thus reduce bullet accuracy to the target as well as achieve poor penetration in the target.

Consequently, a need still exists for a bullet that more nearly approaches the ideal parameters set forth above by overcoming the aforementioned drawbacks of the prior art bullets without introducing new drawbacks in their place.

SUMMARY OF THE INVENTION

The present invention satisfies the aforementioned need by providing a dividing bullet with longitudinally-extending individually-jacketed projectile segments that are joined together so as to adapt them to separate from one another upon impact with a target. The dividing bullet of the present invention separates into its individually jacketed projectile segments without fragmentation which creates a corresponding number of large wound channels through an animal or human body. The dividing bullet and its individually jacketed segments have relatively simple constructions. The principle use of the dividing bullet is for hunting and self defense. The dividing bullet can be used in all modern ammunition, black powder muzzle loader rifles, handguns, shotgun slugs and all military applications.

Accordingly, the present invention is directed to a dividing bullet which comprises: (a) a projectile body having a longitudinal central axis and a plurality of individually jacketed longitudinally extending segments, each segment having an inner core of a first material and outer jacket of a second material substantially encasing the inner core of the first material, the plurality of jacketed segments being symmetrically disposed about the longitudinal central axis; and (b) a seam extending through the projectile body between the individually jacketed segments thereof, the individually jacketed segments being joined together at the seam in any suitable manner, such as by a bond that is weaker in strength than the second material making up the outer jacket of each of the jacketed segments such that the projectile body will separate at the seam into the jacketed segments upon impact with a target.

More particularly, the second material of the outer jacket of each of the jacketed segments is greater in strength than the first material of the inner core thereof. The plurality of jacketed segments preferably are two substantially identical segments with the seam extending along a longitudinal mid-plane through the longitudinal central axis of the projectile body, although they can alternatively be three substantially identical segments with the seam extending along three longitudinal planes that meet at the longitudinal central axis of the projectile body, or four substantially identical segments with the seam extending along two longitudinal planes that intersect one another at the longitudinal central axis of the projectile body.

Furthermore, the outer jacket of each of the jacketed segments has a rear base with an opening defined therein exposing the first material of the inner core. Each of the jacketed segments of the projectile body has a substantially flat inner surface disposed adjacent to the flat inner surface of one of the other of the jacketed segments of the projectile body. The relative weakness of the bond at the flat inner surfaces ensures that the dividing bullet upon impact with a target will separate into the individually jacketed segments with the projectile segments producing separate wound channels and exit wounds in the body of the target. The flat inner surfaces of the projectile half members create maximum resistance within the target body which makes larger wound channels therein.

Upon entering the target body, the projectile segments will separate and pivot away from one another so as to tumble and turn their respective flat inner surfaces from a substantially parallel position to the direction of travel wherein the flat inner surfaces substantially face toward one another so as to provide minimum resistance to travel through the target body, to a substantially transverse position to the direction of travel wherein the flat inner surfaces extend in facing relation with the target body so as to provide maximum resistance to their travel through the target body. In the event that at least one of teh segments should tumble 180° and have an opening in the rear base of the jacket exposing the inner core, the projectile would expand thereby increasing its resistance to the path of travel.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 8 is a side elevational view of the dividing bullet during flight before impacting a target.

FIGS. 9 to 12 are a sequence of side elevational views of the dividing bullet progressively separating into its two projectile halves and tumbling after impact with and during penetration of the target.

FIGS. 13 to 15 are a further sequence of side elevational views of the dividing bullet continuing to tumble during penetration of the target and completely reversing orientation.

DETAILED DESCRIPTION OF THE INVENTION

Figures 1, 2, 3, 4, 5, 6, 7, 16, 17:
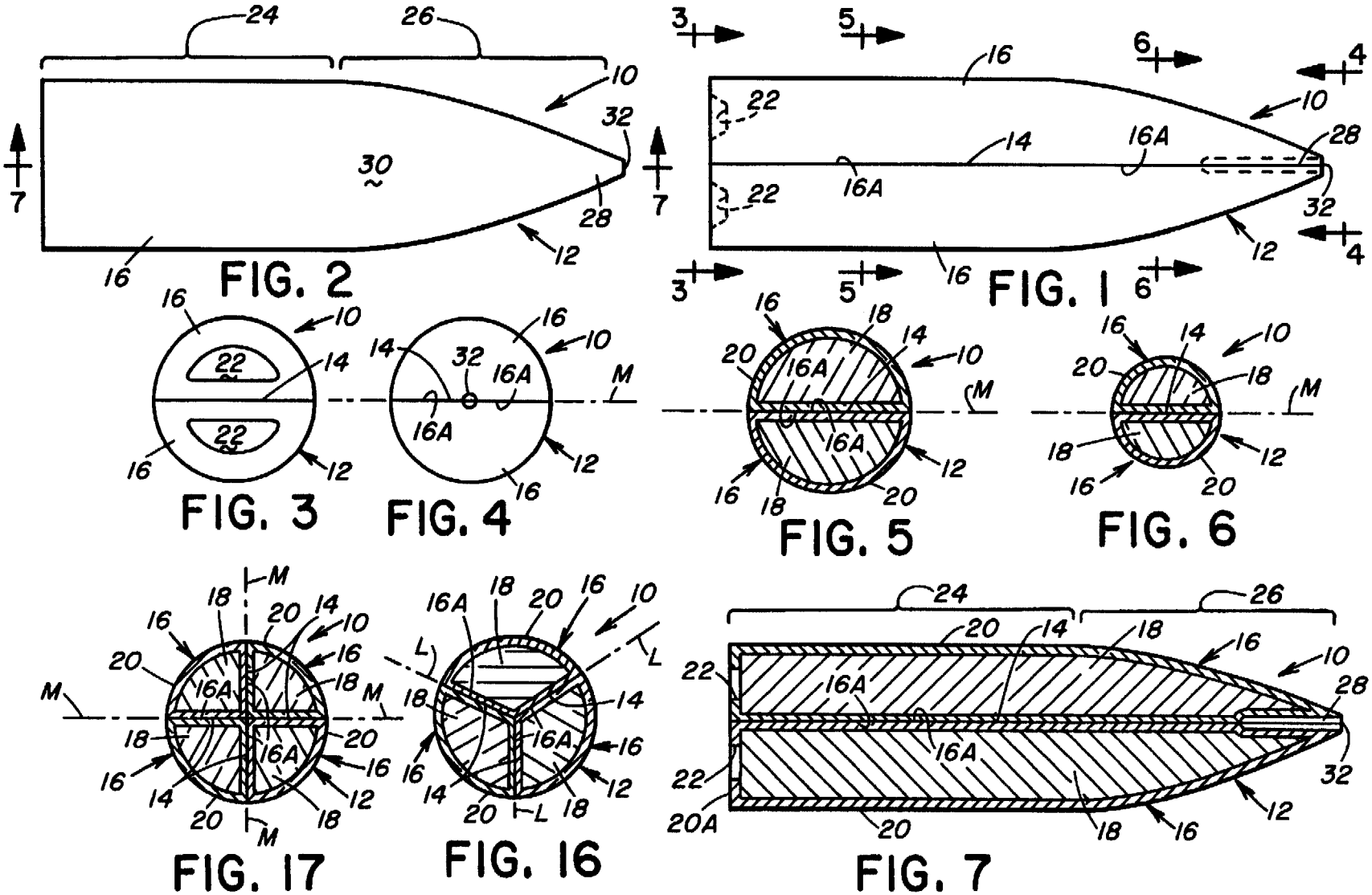
FIG. 1 is a side elevational view of a preferred embodiment of a dividing bullet of the present invention having a projectile body with a pair of individually jacketed longitudinally extending segments symmetrically disposed about a longitudinal central axis of the projectile body.
FIG. 2 is another side elevational view of the dividing bullet after rotation 90° about the longitudinal central axis of the projectile body relative to its orientation in FIG. 1.
FIG. 3 is a trailing end elevational view of the dividing bullet as seen along line 3—3 of FIG. 1.
FIG. 4 is a leading end elevational view of the dividing bullet as seen along line 4—4 of FIG. 1.
FIG. 5 is a cross-sectional view of the projectile body of the dividing bullet taken along line 5—5 of FIG. 1.
FIG. 6 is a cross-sectional view of the projectile body of the dividing bullet taken along line 6—6 of FIG. 1.
FIG. 7 is a longitudinal sectional view of the dividing bullet taken along line 7—7 of FIG. 2.
FIG. 16 is a cross-sectional view of a first modified embodiment of the dividing bullet having three individually jacketed segments.
FIG. 17 is a cross-sectional view of a second modified embodiment of the dividing bullet having four individually jacketed segments.

Referring to the drawings and particularly to FIGS. 1–7, there is illustrated a dividing bullet, generally designated 10, of the present invention. The dividing bullet 10 basically includes a projectile body 12 and a seam 14 through the projectile body 12. The projectile body 12 of the bullet 10 has a longitudinal central axis A and a plurality of individually jacketed, joined together, longitudinally extending segments 16. Each segment 16 has an inner core 18 of a first material and an outer shell or jacket 20 of a second material substantially encasing the inner core 18 of the first material. The plurality of jacketed segments 16 are arranged and disposed symmetrically about the longitudinal central axis A. The second material of the outer jacket 20 is greater in strength than the first material of the inner core 18. Preferably, the first material is substantially ordinary lead, whereas the second material is substantially copper. Other materials could be used within the purview of the present invention. The plurality of jacketed segments 16 can be two, three, four or more in number, although in most instances two or three is preferred. There is a practical limit to the number of segments that can be used.

Furthermore, the outer jacket 20 of each jacketed segment 16 has a rear base 20A with a recess or opening 22 defined therein exposing the first material of the inner core 18. The purpose of this will become apparent later on. Each jacketed segment 16 of the projectile body 12 has a substantially flat inner surface 16A disposed adjacent to the flat inner surface 16A of one of the other of the jacketed segments 16 of the projectile body 12.

The seam 14 in the bullet 10 extends through the projectile body 12 between the individually jacketed segments 16 thereof. The particular configuration of the seam 14 depends on the number of segments 16 employed. The individually jacketed segments 16 are joined together at the seam 14 in any suitable manner, such as by a bond that is weaker in strength than the second material making up the outer jacket 10 of each of the jacketed segments 16 such that the projectile body 12 will separate at the seam 14 into the individual jacketed segments 16 upon impact with a target.

The relative weakness of the bond at the flat inner surfaces 16A ensures that the dividing bullet 10 upon impact with a target will separate into the individually jacketed segments 16 with the projectile segments producing separate wound channels and exit wounds in the body of the target. The flat inner surfaces 16A of the projectile segments 16 create maximum resistance within the target body which makes larger wound channels therein.

The projectile body 12 further has a substantially cylindrical rear portion 24 and a conical front portion 26 being integrally connected to one another. The rear and front portions 24, 26 of the projectile body 12 preferably have substantially circular cross-sectional configurations and, furthermore, the rear portion 24 of the projectile body 12 has a substantially uniform diameter. The front portion 26 of the projectile body 12 has a front tip 28, a rear end 30 and a progressively decreasing diameter from the rear end 30 to the front tip 28 thereof. Also, the front tip 28 of the front portion 26 of the projectile body 12 can optionally have a concave recess 32 defined therein known as a hollow point.

Thus, the dividing bullet 10 because of its symmetrical construction is accurate in flight because it is not lopsided nor will it wobble in flight. Each of the individually jacketed projectile segments 16 are of the same weight, shape and size and thereby are more accurate and effective in use. They produce a plurality of wound channels corresponding to their number that results in a stronger concussion, greater shock, and killing power.

Referring now to FIGS. 8 to 15, upon entering the target body (not shown), the projectile segments 16 of the projectile body 12 (only two being shown for simplicity sake) will typically pivot away from one another so as to tumble and reorient their respective flat inner surfaces 16A from substantially parallel relation to the direction of travel T, as shown in FIG. 8, wherein the flat inner surfaces 16A face toward one another so as to provide minimum resistance to travel through the target body, to a substantially transverse relation to the direction of travel T, as shown in FIG. 12, wherein the flat inner surfaces 16A extend in facing relation with the target body so as to provide maximum resistance to their travel through the target body. As the projectile segments 16 continue to tumble, as depicted in FIGS. 13 to 15, and completely turn around with their trailing ends now their leading ends, mushrooming may occur. The mushrooming effect is enhanced if the projectile segments 16 have openings 20 in their originally trailing ends, as shown in FIGS. 1, 3 and 7. This mushrooming facilitates more damage with a multiple wound path through the target body.

The individual jacketed construction of the projectile segments 16 will minimize fragmentation during travel through the target body and so that upon striking the target body the dividing bullet 10 will separate into the individually jacketed projectile segments 16 without fragmentation. Thus, the projectile segments 16 will penetrate deeper into the target body with a high probability of exiting and making the blood trail when wounding game.

The dividing bullet 10 can be made easily and cheaply by using well-known conventional machines and manufacturing techniques which would be readily known to those of ordinary skill in the art. The jacketed segments 16 are made separately and then brought together in the desired arrangement so that they may be joined together by any suitable means.

The plurality of individually jacketed segments 16 making up the projectile body 12 of the dividing bullet 10 preferably take the form of two substantially identical segments 16, as shown in FIGS. 1–7. The seam 14 between them extends along a longitudinal mid-plane P through the longitudinal central axis A of the projectile body 12. Alternatively, the projectile body 12 of the dividing bullet 10 can be three substantially identical segments 16, as shown in FIG. 16, with the seam 14 extending along three longitudinal planes L that meet at the longitudinal central axis A of the projectile body 12, or four substantially identical segments 16, as seen in FIG. 17, with the seam 14 extending along two longitudinal planes M that intersect one another at the longitudinal central axis C of the projectile body 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A dividing bullet, comprising:

(a) a projectile body having a longitudinal central axis and a plurality of individually jacketed longitudinally extending segments, each of said segments having an inner core composed substantially of lead and outer jacket composed substantially of copper encasing said inner core, said plurality of jacketed segments being symmetrically disposed about said longitudinal central axis; and (b) a seam extending through said projectile body between said individually jacketed segments thereof, said individually jacketed segments being joined together at said seam by a joint that is weaker in strength than said copper composition of said outer jacket of each of said jacketed segments such that said projectile body will separate at said seam into said jacketed segments upon impact with a target.

2. The dividing bullet of claim 1 wherein said plurality of jacketed segments are two substantially identical segments and said seam extends along a longitudinal mid-plane through said central longitudinal axis of said projectile body.

3. The dividing bullet of claim 1 wherein said plurality of jacketed segments are three substantially identical segments and said seam extends along three longitudinal planes that meet at said longitudinal central axis of said projectile body.

4. The dividing bullet of claim 1 wherein said plurality of jacketed segments are four substantially identical segments and said seam extends along two longitudinal planes that intersect one another at said longitudinal central axis of said projectile body.

5. The dividing bullet of claim 1 wherein said outer jacket of each of said jacketed segments has a rear base with a recess defined therein exposing said inner core.

6. The dividing bullet of claim 1 wherein said projectile body further has a substantially cylindrical rear portion and a substantially conical front portion.

7. The dividing bullet of claim 6 wherein said rear portion and said front portion of said projectile body each have a substantially circular cross-sectional configuration.

8. The dividing bullet of claim 6 wherein said rear portion of said projectile body has a substantially uniform diameter.

9. The dividing bullet of claim 6 wherein said front portion of said projectile body has a front tip, a rear end and a progressively decreasing diameter from said rear end to said front tip thereof.

10. The dividing bullet of claim 9 wherein said front tip of said front portion of said projectile body has a hollow point defined therein.

11. The dividing bullet of claim 1 wherein each of said jacketed segments of said projectile body has a substantially flat inner surface being disposed adjacent to said flat inner surface of one of said other of said jacketed segments of said projectile body.

12. A dividing bullet, comprising:

(a) a projectile body having a longitudinal central axis and a plurality of individually jacketed longitudinally extending segments, each of said jacketed segments having an inner core composed substantially of lead and outer jacket composed substantially of copper encasing said inner core, said copper composition of said outer jacket of each of said jacketed segments being greater in strength than said lead composition of said inner core thereof, said plurality of jacketed segments being symmetrically disposed about said longitudinal central axis, each of said jacketed segments having a substantially flat inner surface being disposed adjacent to said flat inner surface of one of said other of said jacketed segments, said projectile body also having a rear portion of substantially cylindrical configuration and a front portion of substantially conical configuration; and (b) a seam extending through said projectile body between said individually jacketed segments thereof, said individually jacketed segments being joined together by a joint that is weaker in strength than said copper composition of said outer jacket of each of said jacketed segments such that said projectile body will separate at said seam into said jacketed segments upon impact with a target.

13. The dividing bullet of claim 12 wherein said plurality of jacketed segments are two substantially identical segments and said seam extends along a longitudinal mid-plane through said central longitudinal axis of said projectile body.

14. The dividing bullet of claim 12 wherein said plurality of jacketed segments are three substantially identical segments and said seam extends along three longitudinal planes that meet at said longitudinal central axis of said projectile body.

15. The dividing bullet of claim 12 wherein said plurality of jacketed segments are four substantially identical segments and said seam extends along two longitudinal planes that intersect one another at said longitudinal central axis of said projectile body.

16. The dividing bullet of claim 12 wherein said outer jacket of each of said jacketed segments has a rear base with a recess defined therein exposing said inner core.

17. The dividing bullet of claim 12 wherein said rear portion and said front portion of said projectile body each have a substantially circular cross-sectional configuration, said rear portion having a substantially uniform diameter, said front portion having a diameter that progressively decreases from a rear end to a front tip of said front portion, said front tip of said front portion of said projectile body having a hollow point defined therein.

* * * * *